United States Patent [19]

Harries

[11] Patent Number: 4,966,416

[45] Date of Patent: Oct. 30, 1990

[54] FRAGMENTATION OF AN UNDERGROUND ORE BODY

[75] Inventor: Gwyn Harries, Elsternwick, Australia

[73] Assignee: ICI Australia Limited, Victoria, Australia

[21] Appl. No.: 801,969

[22] Filed: Jan. 17, 1986

Related U.S. Application Data

[63] Continuation of Ser. No. 397,345, Jul. 12, 1982, abandoned.

[30] Foreign Application Priority Data

Jul. 21, 1981 [AU] Australia ..... PE 9823

[51] Int. Cl.[5] ..... E21B 43/00; E21B 43/263

[52] U.S. Cl. ..... 299/13; 166/271; 166/259; 299/4; 102/311

[58] Field of Search ..... 102/311, 312; 166/247, 166/256, 258, 259, 271; 299/4, 5, 13

[56] References Cited

U.S. PATENT DOCUMENTS 4,210,366 7/1980 Hutchins et al. ..... 299/2

4,223,734 9/1980 Lekas ..... 299/4

*Primary Examiner*—William P. Neuder

*Attorney, Agent, or Firm*—Cushman, Darby & Cushman

[57] ABSTRACT

The invention provides a process for converting subterraneous ore overlain by an adjacent formation of porous rock into an enclosed zone of fragmented ore by first blasting a void space in the porous rock and secondly explosively expanding the ore into the void space. The invention also provides a process for the extraction and recovery of values from a subterraneous ore overlain by an adjacent formation of porous rock. The invention is particularly useful for the extraction and recovery of carbonaceous values from subterraneous oil shale.

11 Claims, 5 Drawing Sheets

FRAGMENTATION OF AN UNDERGROUND ORE BODY

This is a continuation of application Ser. No. 397,345, filed July 12, 1982, now abandoned.

This invention related to a process for the fragmentation of a subterranean ore deposit.

It is well known that there are many valuable subterranean ore deposits which, for a variety of reasons, are not suitable for exploitation by conventional mining methods. For example, it may not be economic to mine certain subterranean metalliferous ore deposits which have low mineral values and it may be ecologically undesirable to strip mine large areas to enable the recovery of carbonaceous materials from subterranean deposits of oil shale.

In recent years much effort has been devoted to developing means for the in situ recovery of values from subterranean ore deposits. For example, the recovery of metal values from metalliferous ores by leaching the ore body and the recovery of oil and hydrocarbon gases from subterranean oil shale deposits by in situ retorting. In general such in situ recovery processes require the fragmentation of the ore body to produce a zone of pervious material so that the required values may be extracted.

Many processes have been described for the formation of subterranean retorts in oil shale by firing explosive charges in the oil shale. However, in practice this has necessitated either excavating a void in the oil shale and explosively expanding the oil shale into that void, for example as described in U.S. Pat. No 4,192,554, or explosively expanding the oil shale and dislocating the overburden, for example as described in U.S. Pat. No. 4,205,610.

The former method has the disadvantage of requiring the removal of portion of the deposit necessitating above ground processing and disposal. The latter method suffers the disadvantage of dislocation of the ground surface resulting in the introduction of fissures into the overburden which need to be sealed before retorting is commenced.

It has now been found that if an ore deposit is overlain by a formation of porous rock, the ore may be explosively fragmented without dislocation of the ground surface above.

Accordingly the invention provides a process for converting subterraneous ore overlain by an adjacent formation of porous rock into an enclosed zone of fragmented ore which process comprises first detonating explosives within said porous rock to form a void space adjacent to said ore and secondly detonating explosives within said ore to fragment said ore and to distribute said void space.

In the process of the present invention it is essential that explosive charges first be detonated within the formation of porous rock to fragment and compress that rock creating a void. The explosive charges within the ore body may then be detonated in order to explosively expand the ore body into the void and give an enclosed, fragmented body of ore. The detonation within the formation of porous rock and the detonation within the order body may be carried out in separate operations. However, preferably the enclosed zone of fragmented ore is prepared in one blasting operation with delay devices being used to ensure that the void space in the formation of porous rock is fully formed before the initiation of the detonation within the ore body. Such delay devices are well known in the art and include, for example, millisecond delay electric detonators. Suitable delays between the initiation of the explosives within the porous rock and the explosives within the ore are of the order of tens of milliseconds.

Conveniently, a plurality of blastholes are drilled through the overburden, overlying porous rock formation and into the ore body. Explosive charges are then placed in the blastholes within the ore body for the fragmentation of the ore body. The explosive charges to be used to compress the porous rock overlying the ore body and form a void space may be placed in the same blastholes separated from the explosive charges in the ore body by suitable stemming material. Preferably the explosive charges used to compress the porous rock overlying the ore body are placed within the porous rock at the interface between the porous rock formation and the ore body. If desired, additional blastholes can be drilled into the porous rock formation to allow extra explosive charges to be placed in the porous rock layer. Such additional charges may aid in the formation of a void space which will ensure optimum explosive expansion and fragmentation of the ore body.

In order to facilitate the subsequent extraction and recovery of values from the ore it is preferable that the enclosed zone of fragmented ore produced by the process of the present invention has a floor which slopes progressively from a shallow end to a deep end so that fluid may drain to the deep end or sump. A subterranean zone of fragmented ore having a floor progressively sloping from a shallow end to a deep end may be produced according to the process of the present invention by placing the explosives within the ore at progressively increasing depths.

In the preparation, according to the process of the present invention, of a subterranean zone of fragmented ore having a floor progressively sloping from a shallow end to a deep end, in order to ensure optimum blast performance it is preferred that the blast initiation is sequenced from the shallower explosive charges to the deeper explosive charges. Such a sequencing of blast initiation may be readily effected by utilizing delay devices which are well known in the art. Examples of such delay devices include millisecond delay electric detonators and suitable delays between the initiation of each explosive charge are of the order of milliseconds.

The porosity of the porous rock formation overlying the ore body is not narrowly critical to the process of the present invention an depends to a large extent on the swell required to enable the ore body to be fragmented into a rubble mass suitable for extraction of the required values. For example, a swell of above 10 percent is preferable when oil shale is explosively fragmented in situ, in order to obtain a rubble mass which has optimum in situ retorting characteristics. Therefore, in preparing an in situ oil shale retort using the process of the present invention it is preferable that the average combined porosity of the overlying porous rock formation and the oil shale is greater than 10 percent. Preferably the porosity of the porous rock formation is greater than or equal to approximately 20 percent.

The specific "blast design" used in the process of the invention will depend on the depth of the overburden and the thickness and properties of both the subterranean ore body and the overlying formation of porous rock. The term "blast design" is used herein to include such variables as blasthole diameter, blasthole spacing, blasthole pattern and depth, size and location of explosive charge within each blasthole, and energy of each explosive charge. Given the parameters of the depth of the overburden and the thickness and properties of both the subterranean ore body and the overlying formation of porous rock a suitable "blast design" may be developed by those skilled in the art and optimized without undue experimentation.

The enclosed zone of fragmented ore prepared according to the process of the present invention is in a form which is eminently suitable for the recovery of values therefrom. Therefore, in a further aspect the invention provides a process for the extraction and recovery of values from a subterraneous ore overlain by an adjacent formation of porous rock which process comprises:

(a) forming an enclosed zone of fragmented ore by first detonating explosives within said porous rock to form a void space adjacent to said ore and secondly detonating explosives within said ore to fragment said ore and to distribute said void space;

(b) providing inlet means into said zone for initiating and controlling the extraction of said values from said fragmented ore;

(c) providing outlet means into said zone for withdrawing said values therefrom;

(d) initiating the extraction utilizing said inlet means; and (e) continuing the extraction and recovering said values utilizing said outlet means.

The process of the present invention is particularly suitable for the preparation of in situ retorts of fragmented oil shale in seams of oil shale overlain by an adjacent formation of porous rock and the extraction and recovery of carbonaceous values from the fragmented oil shale.

After a zone of oil shale has been explosively fragmented according to the process of the present invention to give an in situ retort, retorting may be effected either by igniting the fragmented oil shale and moving a combustion front therethrough or by injecting gases or liquids into the oil shale at elevated temperatures to extract liquid products from the shale. In the process of the present invention, retoring is preferably effected by ignition and controlled combustion of the oil shale.

In the process of extraction and recovery of carbonaceous values from an in situ retort, preferably the fragmented oil shale is ignited at one end, the inlet end, of the retort to establish a combustion zone and an oxygen-containing feed is introduced into the inlet end of the retort to supply oxygen to the combustion zone and to cause the combustion zone or front to advance through the retort. In the combustion zone hot carbonaceous material and the introduced oxygen burn generating heat and combustion gas. The heat generated causes the decomposition of the kerogen in the oil shale leaving a residual solid carbonaceous material and giving gaseous and liquid products which are forced ahead of the advancing combustion zone. The gaseous and liquid products are cooled as they advance through the unretorted oil shale and may be withdrawn from the opposite or outlet end of the retort. The residual solid carbonaceous material in the retorted oil shale acts as a fuel for the advancing combustion zone. The rate of advance of the combustion zone through the fragmented oil shale may be controlled by the rate of introduction of the oxygen-containing feed into the retort to give optimum recovery of liquid and gaseous products from the fragmented oil shale.

The process of the present invention is also suitable for the preparation of subterraneous zones of fragmented metalliferous ores in seams of metalliferous ores overlain by an adjacent formation of porous rock, and the extraction and recovery of metal values from the fragmented metalliferous ore. After a subterraneous zone of metalliferous has been explosively fragmented according to the process of the present invention the metal values may be extracted and recovered by, for example, leaching.

Many deposits of oil shale also contain valuable minerals such as, for example, vanadium and molybdenum, but at levels which are too low to enable them to be economically recovered by conventional means. In such deposits overlain by an adjacent formation of porous rock the process of the present invention may be used to advantage to recover both the carbonaceous values and the mineral values by first retorting an enclosed zone of fragmented ore, prepared according to the process of the present invention, to recover the carbonaceous values therefrom and secondly extracting and recovering the mineral values from the retorted oil shale to recover the mineral values therefrom.

In order to provide a better understanding of the invention a preferred embodiment will now be described. The following description of the use of the process of the invention for the preparation of an in situ oil shale retort and the extraction and recovery of carbonaceous values therefrom is made by way of example only and with reference to the accompanying diagrammatic drawings in which.

Figure 1:
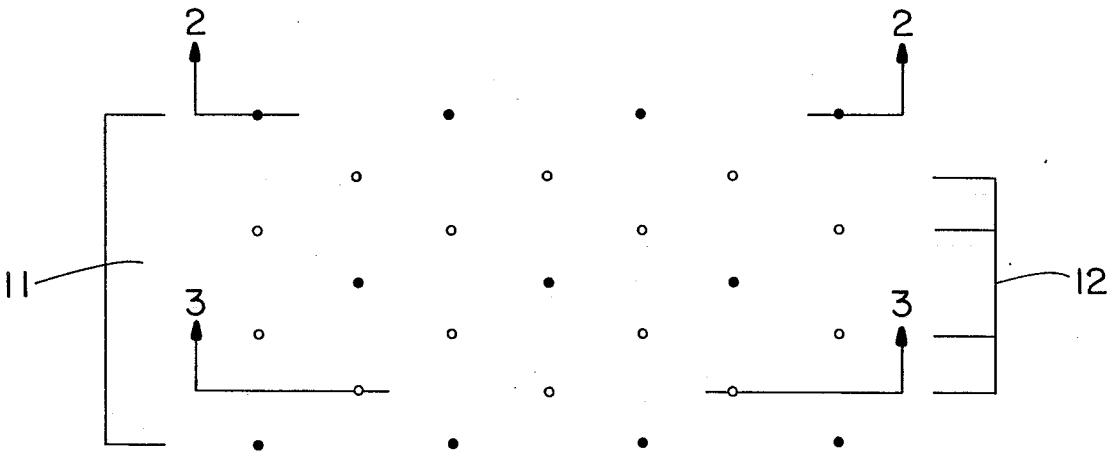
FIG. 1 is a fragmentary, semi-schematic plan view showing a pattern of blastholes on the surface of the earth above a preselected oil shale deposit.
Figure 3:
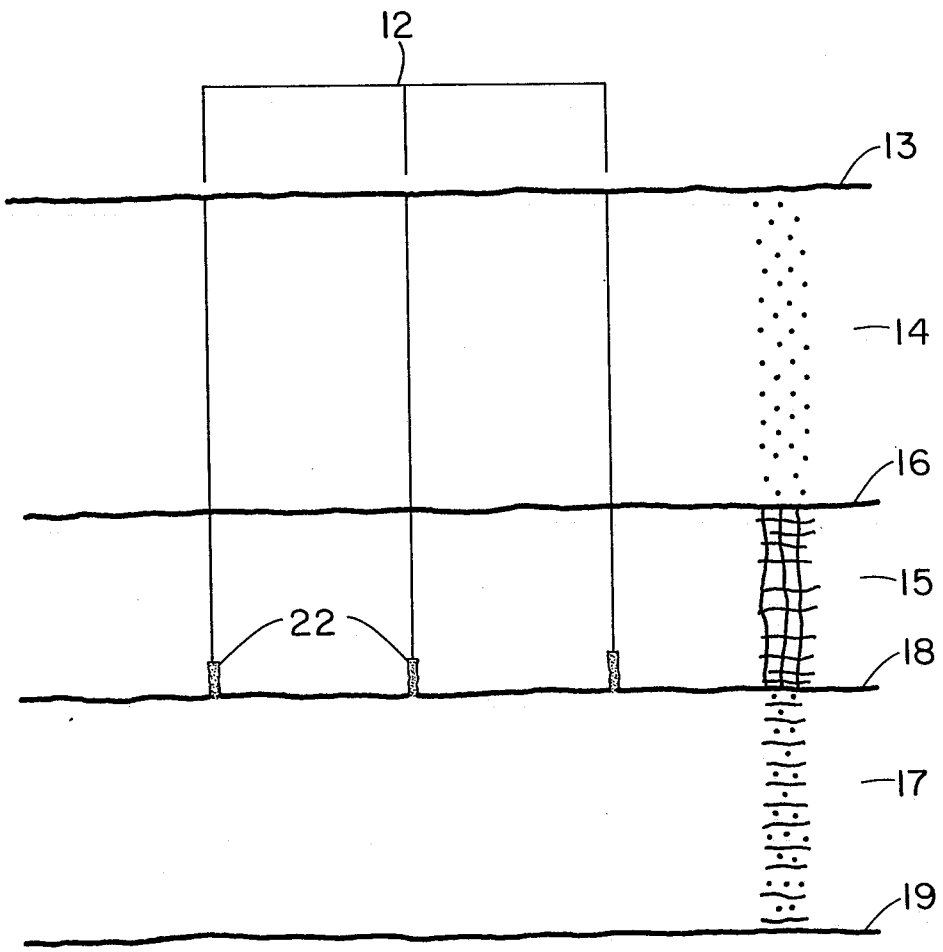
FIG. 3 is a fragmentary, semi-schematic vertical cross-sectional view taken along line 3—3 of FIG. 1 and showing the same subterranean formation illustrated in FIG. 2.
Figure 4:
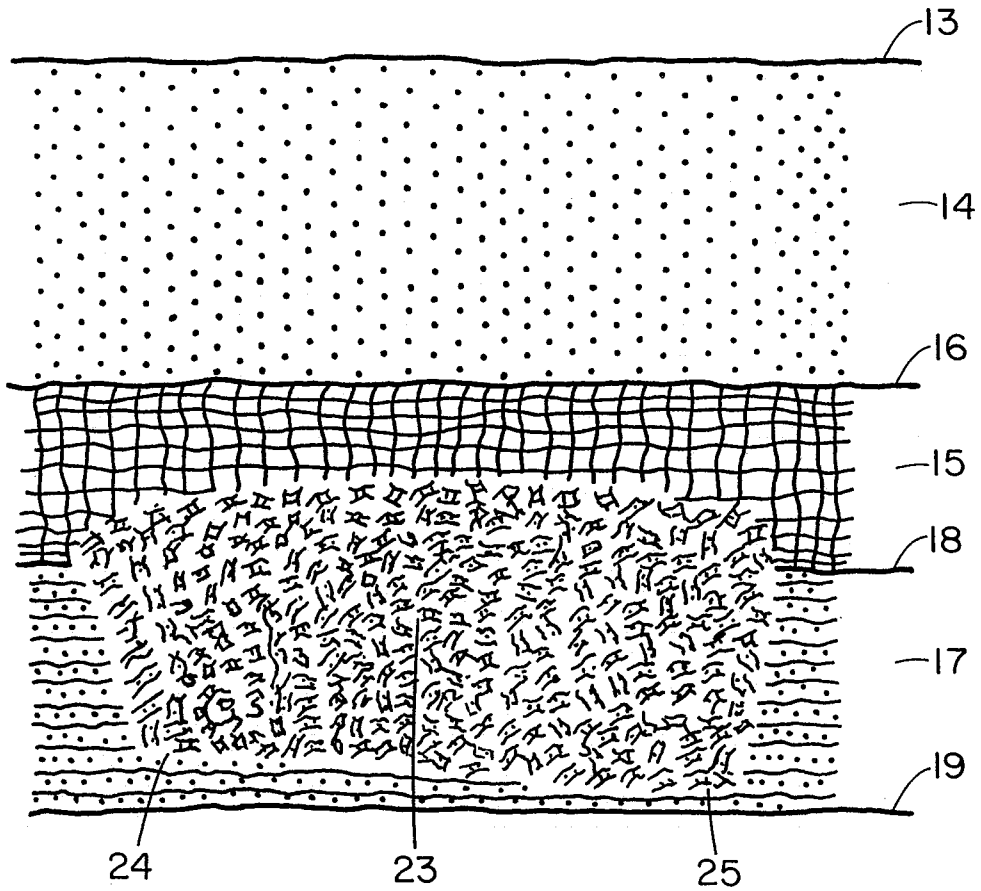
Figure 5:
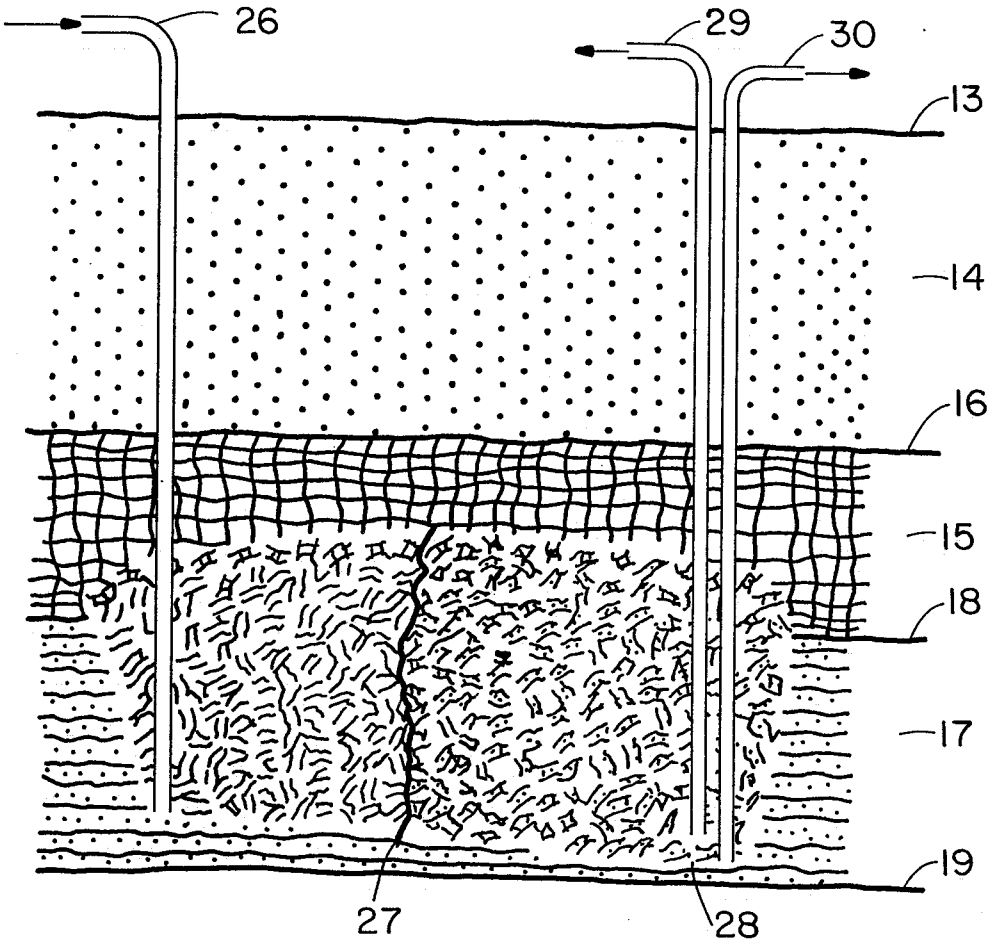

FIG. 4 is a fragmentary, semi-schematic vertical cross-sectional view taken along line 3—3 of FIG. 1 showing the subterranean formation illustrated in FIG. 3 after explosive expansion according to the process of the invention; and FIG. 5 is a fragmentary, semi-schematic vertical cross-sectional view taken along the line 3—3 of FIG. 1 showing the subterranean formation illustrated in FIG. 4 during in situ retorting of the fragmented oil shale.

It should be noted that FIGS. 1 to 5 are not drawn to scale and the relative dimensions and proportions of some parts of these Figures have been shown exaggerated or reduced for the sake of clarity and convenience.

The plan view illustrated in FIG. 1 shows blastholes 11 in an equilaterial triangular pattern which are drilled into the oil shale. The blastholes may be arranged in any other suitable pattern such as, for example, a staggered pattern, depending on the most suitable overall blast design. FIG. 1 also shows optionally intermediate blastholes 12 which may be drilled to the interface between the porous rock formation and the oil shale to facilitate the formation of a void in the porous rock formation.

Figure 2:
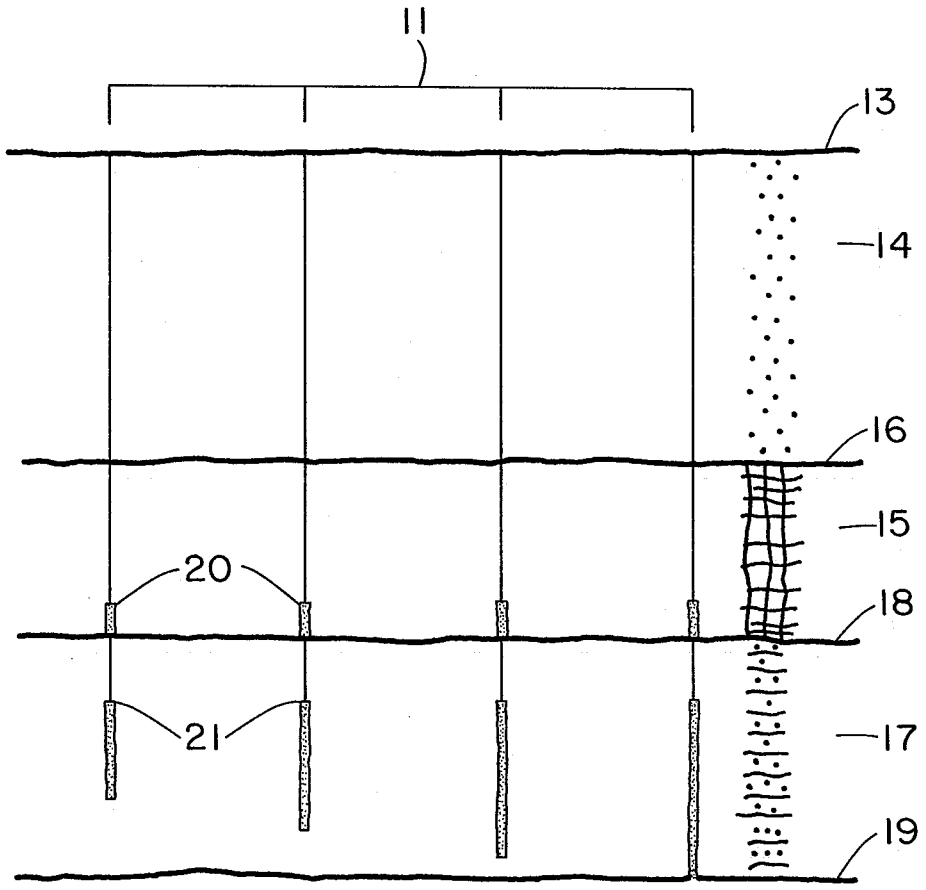
FIG. 2 is a fragmentary, semi-schematic vertical cross-sectional view taken along the line 2—2 of FIG. 1 and showing a subterranean formation containing a formation of porous rock overlying a bed of oil shale which has been prepared for explosive expansion according to the process of the invention.

The cross-sectional view of a subterranean formation illustrated in FIG. 2 shows the ground surface 13, overburden layer(s) 14, formation of porous rock 15, interface 16 between the overburden layer(s) 14 and the porous rock formation 15, layer of oil shale 17, interface 18 between the layer of oil shale 17 and the porous rock formation 15, and the floor 19 of the layer of oil shale 17. A plurality of blastholes 11 extend from the ground surface 13 into the layer of oil shale 17. In FIG. 2 the depth of the blastholes 11 has been shown as progressively increasing with a view to producing a retort with a sloping base to facilitate the collection of liquid hydrocarbons from the in situ retorting process. In an alternative design the depth of the blastholes could be increased from both ends towards the centre to produce a retort with a base sloping towards its centre in order to drain the liquid hydrocarbons produced in the retorting process to the centre of the retort.

A plurality of explosive charges 20 are positioned in the porous rock formation 15 at the interface 18 to enable the explosive compression of the porous rock formation 15 adjacent to the layer of oil shale 17 to form a void space in the porous rock formation 15 at the interface 18. A plurality of explosive charges 21 are positioned in the oil shale layer 17 to enable the oil shale to be fragmented and explosively expanded into the void formed in the porous rock formation 15 at the interface 18. The explosive charges 20 and 21, positioned in the same blasthole 11, are separated by a suitable stemming material such as, for example, angular crushed rock.

FIG. 3 shows a plurality of optional blastholes 12 extending to the interface 18 between the porous rock formation 15 and the layer of oil shale 17. Explosive charges 22 are placed in the optional intermediate blastholes 12 to aid in the formation of a void in the 20 porous rock formation 15.

In practice in the process of the present invention the explosive charges 20 and optional explosive charges 22 are first fired to blast a void space in the porous rock formation 15 at the interface 18 between that formation and the layer of oil shale 17. The explosive charges 21 in the oil shale layer 17 are then fired to fragment and explosively expand the oil shale into the void space. While the void space and the oil shale can be blasted in separate operations it is convenient to blast the void space and explosively expand the oil shale in one operation using delay devices known in the art. In this operation, the charges in the formation of porous rock are detonated first to ensure that the void space is fully formed before the charges in the oil shale are detonated. As shown in FIG. 2, preferably, the explosive charges 21 are position at progressively increasing depths in the oil shale 17 with a view to preparing an in situ retort with a sloping floor to facilitate the collection of liquid hydrocarbon formed in the in situ retorting process. In order to form an in situ retort of this design with optimum blast performance it is preferred that the blast initiation should be sequenced from the shallower explosive charges to the deeper explosive charges.

FIG. 4 shows and enclosed zone of fragmented oil shale 23, prepared according to the process of the present invention, with a floor sloping progressively from a shallow end 24 to a deeper end 25.

FIG. 5 shows the enclosed zone of fragmented oil shale illustrated in FIG. 4 but during the retorting process. Suitable inlet conduit 26 are provided at one end of the enclosed zone of fragmented oil shale for the introduction of a means of initiating and/or supporting controlled combustion in the fragmented oil shale. The combustion process moves through the fragmented oil shale along a front 27 extracting fluids and gases from the fragmented oil shale driving them to the opposite end of the enclosed zone where the gases may be recovered by means of outlet conduit 29 and the fluids may be pumped from the retort by means of conduit 30 which communicates with a sump 28 in the floor of the retort provided for the collection of fluids.

It will be evident to those skilled in the art that the process of the present invention offers significant economic advantages over prior art processes, as it enables the preparation of a subterraneous enclosed zone of evenly fragmented ore with the minimum of site preparation and without dislocation of the overburden.

I claim:

1. A process for converting subterraneous ore into a mass of fragmented ore which process consists of the steps of placing explosives within a rock formation consisting of a ground surface, an overburden layer, a porous rock layer having a porosity of at least 10%, an interface in contact with the lower surface of the overburden and the upper surface of the porous rock formation, an ore body below said porous rock formation, and an interface in contact with the upper surface of said ore body and the lower surface of said porous rock formation, detonating explosive charges within said porous rock layer to fragment and compress the porous rock without elevating the surface above the formation and to create a void space adjacent the ore body, and then detonating explosives within the ore body to fragment said ore body and distribute it within said void space.

2. A process according to claim 1 wherein the enclosed zone of fragmented ore is prepared in one blasting operation using delay devices to ensure that the void space is formed by the first detonation before the initiation of the second detonation.

3. A process according to claim 1 wherein the explosives within the porous rock are placed at the interface between the porous rock formation and the ore.

4. A process according to claim 1 wherein the explosives are placed in a plurality of blastholes drilled from the surface into the ore.

5. A process according to claim 4 wherein the explosives within the ore and the porous rock are placed in the same blastholes and are separated by stemming material.

6. A process according to claim 5 wherein additional explosives are placed in blastholes drilled from the surface into the porous rock.

7. A process according to claim 5 wherein the explosives within the ore are placed at progressively increasing depths in order to form an enclosed zone of fragmented ore which has a floor sloping progressively from a shallow end to a deep end.

8. A process according to claim 7 wherein detonation of the explosives within the ore is sequenced from the shallow charges to the deep charges.

9. A process according to claim 1 wherein the porosity of the porous rock is equal to or greater than 20%.

10. A process according to claim 1 wherein the ore is oil shale.

11. A process for converting subterraneous ore into a mass of fragmented ore which process consists of the steps of placing explosives within a rock formation consisting of a ground surface, an overburden layer, a porous rock layer having a porosity of at least 10%, an interface in contact with the lower surface of the overburden and the upper surface of the porous rock formation, an ore body below said porous rock formation and an interface in contact with the upper surface of said ore body and the lower surface of said porous rock formation, detonating explosive charges within said porous rock layer to fragment and compress the porous rock, the porosity of said rock being sufficient that a void space is created adjacent the ore body without elevating the surface above the formation, and then detonating explosives with the ore body to fragment said ore body and distribute it within said void space.

* * * * *